US005144873A

United States Patent [19]

Nasu

[11] Patent Number: 5,144,873

[45] Date of Patent: Sep. 8, 1992

[54] METHOD AND APPARATUS FOR CUTTING PATTERNED SHEETS

[75] Inventor: Nobuo Nasu, Fukuyama, Japan

[73] Assignee: Kabushiki Kaisha Kawakami Seisakusho, Hiroshima, Japan

[21] Appl. No.: 567,804

[22] Filed: Aug. 15, 1990

[30] Foreign Application Priority Data

Sep. 19, 1989 [JP] Japan ..... 1-240734

[51] Int. Cl.[5] ..... B26D 7/02

[52] U.S. Cl. ..... 83/19; 83/22; 83/29; 83/176; 83/451; 83/939; 269/21; 269/54.5

[58] Field of Search ..... 83/19, 22, 29, 176, 83/451, 939; 269/21, 54.5

[56] References Cited

U.S. PATENT DOCUMENTS

| | | | |
|---|---|---|---|
| 1,750,463 | 3/1930 | Deinstein | 269/54.5 |
| 2,572,204 | 10/1951 | Schneider et al. | 269/54.5 |
| 3,386,728 | 6/1968 | Smakel | 269/289 |
| 3,695,134 | 10/1972 | Hardwick | 83/451 |
| 3,783,728 | 1/1974 | Glasman et al. | 83/660 |
| 4,725,393 | 2/1988 | Nasu | 83/451 |
| 4,807,504 | 2/1989 | Vandermarliere | 83/22 |

FOREIGN PATENT DOCUMENTS

| | | | |
|---|---|---|---|
| 2141362 | 2/1973 | Fed. Rep. of Germany | 83/939 |

*Primary Examiner*—Frank T. Yost
*Attorney, Agent, or Firm*—Ladas & Parry

[57] ABSTRACT

Disclosed herein is an apparatus for cutting patterned sheets. The apparatus is made of a support surface formed on an upper side of a pedestal. Needle holders having removable needles therein are disposed above said support surface and held adjustably by a base member. The apparatus also includes a suction pipe disposed on one side edge of the support surface. The suction pipe is used with an envelope of air-impervious material and forms one edge of the envelope.

7 Claims, 2 Drawing Sheets

METHOD AND APPARATUS FOR CUTTING PATTERNED SHEETS

BACKGROUND OF THE INVENTION

This invention relates to a method and apparatus for cutting patterned sheets, in which a laminate composed of patterned sheets such as patterned cloth stacked with their patterns matched using needles is compressed by withdrawal of air and then cut.

In the prior art, patterned sheets such as patterned cloth are stacked on a laminate pedestal with their patterns matched. This is accomplished by holding the patterned sheets directly on a pedestal for a laminate, matching the pattern positions and then impaling the sheets on projecting needles. The laminate consisting of these patterned sheets is cut by the cutter of a cutting machine which is being manually guided. Since the needles are an impediment to cutting, the cutting of the laminate proceeds while the needles are withdrawn therefrom.

A cutting machine generally used in another example of the prior art holds the laminate of cloth or the like on a support surface by suction in a compressed state obtained by withdrawal of air, and the laminate is cut by an automatic cutter. However, since the cutting machine holds the laminate on the support surface by suction, it would not be possible to extract needle holders or the like if these are interposed between the laminate and the support surface while the laminate is being held by such suction.

In the conventional cutting of a laminate of patterned sheets relying upon the manual guidance mentioned above, the patterned sheets are stacked with their patterns matched using the needles. Nevertheless, since the needles impede the motion of the cutter when the cutting operation is performed, the cutting takes place while the needles holding the laminate in position are removed. Consequently, the laminate cannot be held in position just when it is most necessary. The result is inaccurate cutting caused by a shift in the positions of the patterns. Further, in the conventional cutting machine described above, a problem encountered is that since the needle holders cannot be extracted from between the laminate and it supporting surface, the patterns of the patterned sheets cannot be matched using needles capable of being attached to and detached from the needle holders.

SUMMARY OF THE INVENTION

An object of the present invention is to provide a patterned-sheet cutting method and apparatus in which patterned sheets are stacked in the form of a laminate on a support surface with their patterns matched, the laminate is held on the support surface by suction produced by withdrawing air, and needles and needle holders used in matching the patterns are capable of being removed in this state, where by the patterned sheets can be cut accurately and efficiently without being positioned displaced by manually cutting or by cutting using an automatic cutting machine.

According to the present invention, the foregoing object is attained by providing a method of cutting patterned sheets comprising the steps of: holding needle holders, in each of which a needle is held so as to be capable of being inserted and withdrawn, at prescribed positions on a sheet-like or frame-like base member along with the needles, and supporting the base member on a support surface in such a manner that the needles are upwardly directed; impaling a lower air-impermeable sheet, which is larger than patterned sheets to be stacked, on the needles and supporting the lower air-impermeable sheet on the support via the base member; stacking the patterned sheets on the lower air-impermeable sheet to form a laminate by impaling them on the needles while positions of patterns on the patterned sheets are matched; covering an upper surface of the laminate of patterned sheets as well as side surface of the laminate, with the exception of a side thereof opposing a suction port, with an upper air-impermeable sheet larger than the patterned sheets, and impaling the upper air-impermeable sheet on the needles, thereby enveloping substantially the entire outer surface of the laminate, with the exception of the side thereof opposing the suction port, in the upper and lower air-impermeable sheets; compressing the laminate on the support surface and holding it on the suction port under suction by drawing in air from the suction port, extracting the needles from the needle holders, the laminate and the upper and lower air-impermeable sheets under these conditions, and extracting the needle holders and the base member from between the support surface and the lower air-impermeable sheet; and cutting the laminate, which is held on the suction port by suction, along with the upper and lower air-impermeable sheets while continuing to draw in air from the suction port.

Further, the foregoing object is attained by providing an apparatus for cutting patterned sheets, comprising: a support surface formed on an upper side of a pedestal; needle holders, in each of which a needle is held so as to be capable of being inserted and withdrawn; a sheet-like or frame-like base member detachably disposed on the support surface for detachably holding the needle holders at prescribed positions along with the needles; and a suction port formed longitudinally along a suction pipe disposed on one side edge of the support surface, the suction port opening on a central side of the support surface.

The method of cutting patterned sheets in accordance with the present invention is such that holders in which needles are capable of being inserted and withdrawn are held on a sheet-like or frame-like base member, in which state the base member is supported on a support surface. As a result, the patterned sheets, such as patterned cloth, are accurately matched using the needles while the positions of the patterns on the sheets are verified, and the patterned sheets can be stacked on the support surface via the lower air-impermeable sheet and base member. In addition, the laminate of patterned sheets stacked with their patterns matched is surrounded by the upper and lower air-impermeable sheets, and one side face of the laminate is subjected to suction from a suction port to compress the laminate and cause it to be held by the suction port due to the suction applied. Under these conditions, the needles are extracted from the needle holders, and the needle holder and base member can be withdrawn from between the pedestal and the lower air-impermeable sheet. In this case, the upper and lower air-impermeable sheets and the laminate are being attracted to the suction port, so that the needles, the needle holders and the base member can be extracted with ease. Moreover, there is no shift in the positions of the patterns on the stacked patterned sheets. Accordingly, the laminate can be cut by a cutter operated under manual guidance or by the cutter of an automatic cutting machine having a suction device, without the needles impeding the cutting operation. Since an operation for pulling out the pins need not be inserted during the cutting operation, cutting can be performed efficiently and accurately without the patterns on the patterned sheets being shifted in position at cutting.

The apparatus for cutting patterned sheets according to the invention is so adapted that the needles are extracted from both the needle holders and base member. Therefore, the needle holders and base member can readily be removed from above the support surface of the pedestal after the needles are extracted. Thus, the apparatus of the invention is ideal for practicing the cutting method described above.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of the present invention will now be described with reference to the drawings.

Figure 1:
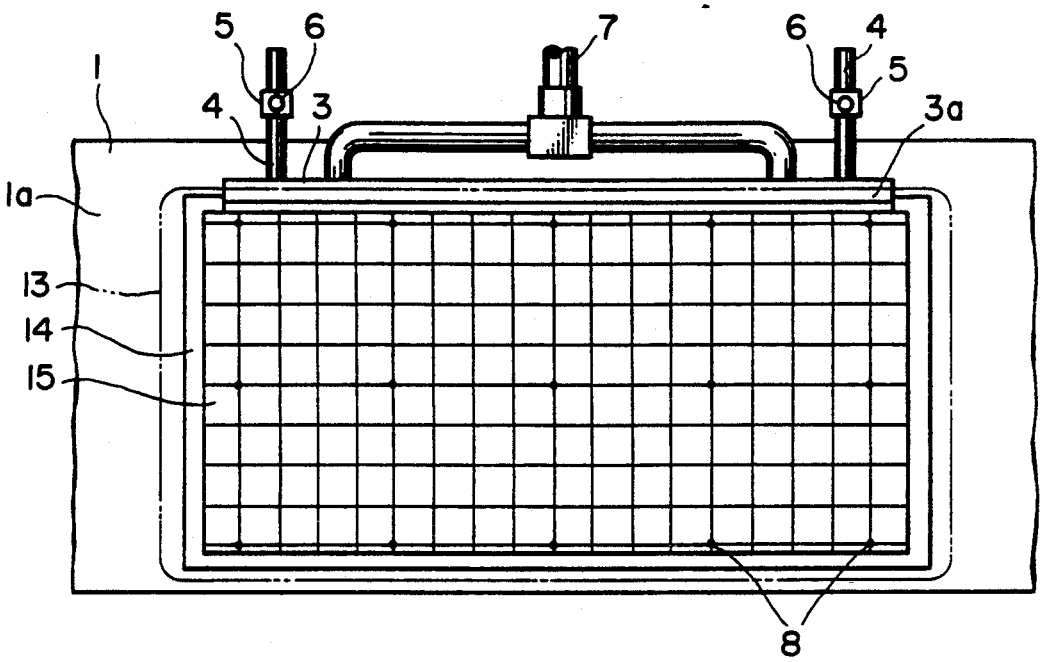
FIG. 1 is a schematic plan view showing an embodiment of a cutting apparatus for cutting patterned sheets according to the present invention.
Figure 2:
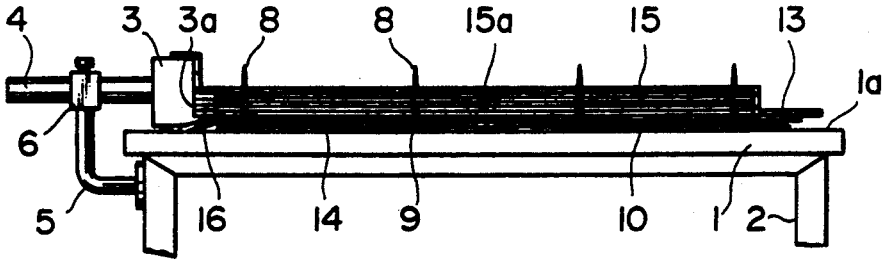
FIGS. 2 and 3 are longitudinal sectional views of the cutting apparatus of FIG. 1 and respectively illustrate a laminate being held by needles and a laminate being held by suction.
Figure 3:
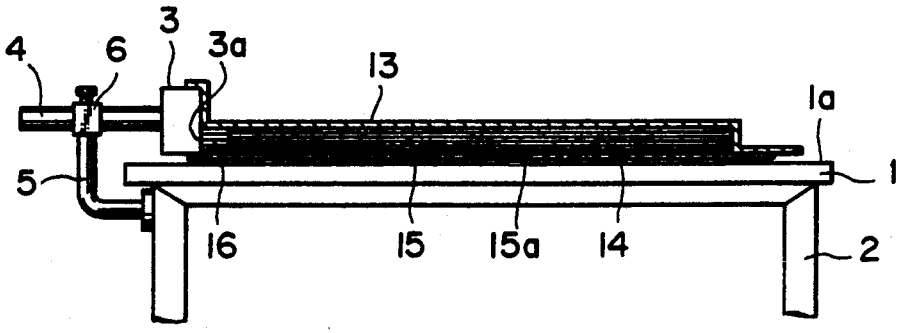

With reference to FIGS. 1, 2 and 3, there is shown a cutting apparatus which includes a pedestal 1 secured to a machine frame 2 and having a support surface formed on its upper side, and a suction pipe 3 disposed on the support surface 1*a* in close proximity to one edge thereof. The suction pipe 3 is formed to have a suction port 3*a* in the longitudinal direction thereof extending along and parallel to the side edge of the support surface 1*a*. The suction port 3*a* is situated centrally of the support surface 1*a* in terms of the width direction thereof. A pair of guide rods 4 are secured to the rear face of the suction pipe 3 and extend outwardly from the support surface 1*a*, and a pair of mounting members 5 are secured to one side face of the pedestal 1. The guide rods 4 are slidably fitted and supported on the distal ends of the corresponding mounting members 5 so that the suction pipe 3 is capable of being translated in the width direction of the support surface 1*a*. A suction pipe fixture 6 comprising a setscrew or the like is fitted on the distal end portion of each mounting member 5. Thus, the arrangement is such that the guide rods 4 can be secured at desired positions by the fixtures 6. The suction pipe 3 is connected to a suction source (not shown) such as a vacuum pump by a connecting pipe 7, a portion of which is constituted by a flexible pipe (not shown).

Figure 4:
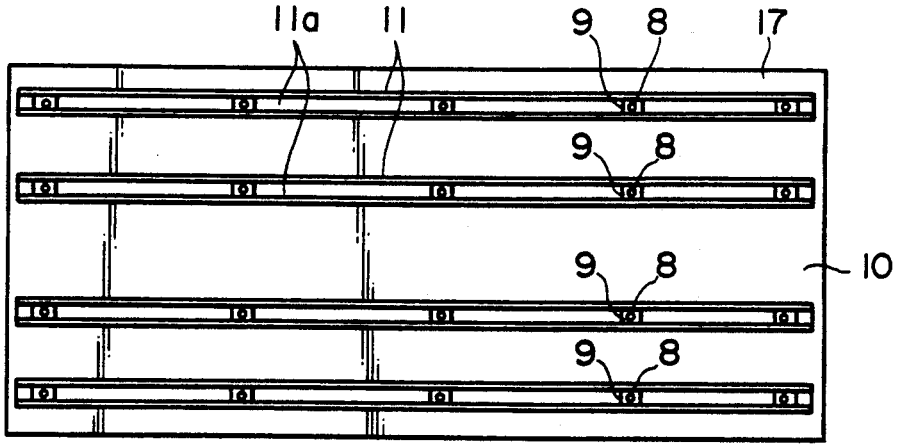
FIG. 4 is a plan view of a base member.
Figure 5:
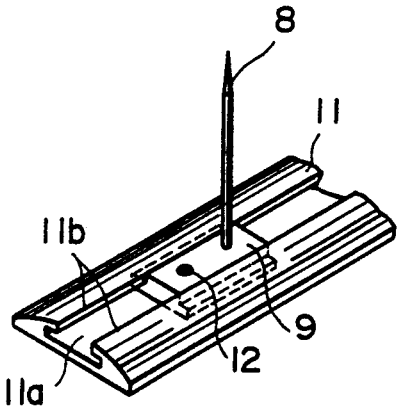
FIG. 5 is an enlarged perspective view in which a needle and a needle holder are held on a holding rail.

Needles shown at numeral 8 each have a base portion thereof fitted into and supported by a respective needle holder 9 in such a manner that the needle can be attached to and detached from the holder. A sheet-like base member 10 includes a planar, rectangularly shaped base sheet 17, and a plurality of holding rails 11 fixed to the upper surface of the base sheet 17 in parallel with the longitudinal direction thereof and spaced apart in the width direction, as shown also in FIG. 4. As illustrated in FIG. 5, engaging grooves 11*a* open on the upper side thereof are formed in respective ones of the holding rails 11 along their entire length, and longitudinally extending projections 11*b* are formed on each holding rail 11 near the opening of the engaging groove 11*a* so as to narrow the width of the groove 11*a* from both sides thereof. The needle holders 9 are removably engaged with the engaging grooves 11*a* so as to slide therealong. By turning a setscrew 12 screwed into each needle holder 9, the needle holder 9 can be fixed at any position along the length of the engaging groove 11*a*.

In FIGS. 1, 2 and 3, numerals 13 and 14 denote upper and lower air-impermeable sheets exhibiting flexibility, such as sheets of polyethylene, and numeral 15 denotes a laminate consisting of stacked patterned sheets 15*a* such as patterned cloth. As shown in FIGS. 2 and 3, an air-permeable spacer 16 comprises expanded styrole or cardboard. A cutter, not shown, cuts the laminate as well as the upper and lower air-impermeable sheets while being guided manually.

A method of cutting patterned sheets using the foregoing cutting apparatus will now be described.

In a first step of the method, the needle holders 9 holding the needles 8 are engaged with the engaging grooves 11*a* in the holding rails 11 of the base member 10, and the holders 9 are fixed at suitable locations along the holding rails 11. Under these conditions, the base member 10 is supported by being placed upon the support surface 1*a* of the pedestal 1 with the needles 8 pointing upward, as depicted in FIGS. 1 and 2. The base member 10 is secured to the support surface 1*a* by suitable means so as to be capable of being attached and detached.

In a second step, the lower air-impermeable sheet 14, the area of which is larger than that of the patterns sheets 15*a*, is impaled upon the needles 8 and is supported on the support surface 1*a* via the base member 10, as shown in FIGS. 1 and 2. At this time, one side edge of the lower air-impermeable sheet 14 is abutted against the lower surface of the suction pipe 3. The air-permeable spacer 16 is placed upon the lower air-impermeable sheet 14 and is abutted against the suction port 3*a* of the suction pipe 3.

In a third step, the patterned sheets 15*a* are matched with regard to their patterns, stacked on the lower air-impermeable sheet 14 and impaled upon the needles 8 while the pattern positions are confirmed, as shown in FIGS. 1 and 2. At this time one side edge portion of the patterned sheets 15*a* is abutted against the suction port 3*a* via the spacer 16.

In a fourth step, the upper surface of the laminate 15 composed of the patterned sheets 15*a* stacked in the third step and the side surface of the laminate 15 with covered with the upper air-impermeable sheet 13, the area of which is larger than that of the patterned sheets 15*a* and lower air-impermeable sheet 14. The upper air-impermeable sheet 13 is also impaled upon the needles 8. One side edge of the upper air-impermeable sheet 13 is abutted against the upper surface of the suction pipe 3, the suction port 3a of the suction pipe 3 is covered by one side edge portion of the upper and lower air-impermeable sheets 13, 14, the outer side edges of the upper and lower air-impermeable sheets 13, 14 with the exception of the aforementioned one side edge portion are overlapped, substantially the entire outer surface of the laminate 15 with the exception of the side facing the suction port 3a is embraced by the upper and lower air-impermeable sheets 13, 14, and the interior surrounded by the upper and lower air-impermeable sheets 13, 14 is communicated with the suction port 3a via the spacer 16. After the laminate 15 is thus enveloped by the upper and lower air-impermeable sheets 13, 14, the outer edge portion where the upper and lower air-impermeable sheets 13, 14 overlap each other is closed by adhesive tape.

In a fifth step, the air inside the laminate 15 is withdrawn from the suction port 3a via the connecting pipe 7 and suction pipe 3 by operating the suction source. As a result, negative pressure is produced within the interior enveloped by the upper and lower air-impermeable sheets 13, 14, thereby compressing the laminate 15 and producing suction to hold the laminate on the suction port 3a via the spacer 16. Under these conditions, the tips of the needles 8 protruding from the upper air-impermeable sheet 13 are pulled upwardly using, where necessary, suitable means, thereby extracting the needles 8 from the needle holders 9 and from the lower air-impermeable sheet 14, laminate 15 and upper air-impermeable sheet 13. All of the needles 8 are thus removed. Next, the needle holders 9 and base member 10 are extracted from between the support surface 1a of the pedestal 1 and the lower surface of the lower air-impermeable sheet 14 so that the laminate 15 comes to be supported on the support surface 1a through the intermediary of the lower air-impermeable sheet 14. Though the upper and lower air-impermeable sheets 13, 14 are left with needle holes after the needles 8 are extracted, the holes are small and allow only a very small amount of air to be drawn in. Consequently, there is almost no change in the negative pressure in the interior enveloped by the upper and lower air-impermeable sheets 13, 14, and the laminate 15 remains compressed and held to the side of the suction port 3a by suction. As a result, the patterned sheets 15a whose patterns have been matched undergo no positional displacement.

Finally, in a sixth step, while air continues to be withdrawn via the suction port 3a , the laminate 15 held on the side of the suction port 3a by suction is cut, along with the upper and lower air-impermeable sheets 13, 14, in a predetermined shape by a cutter operated under manual guidance in a well-known cutting machine. Though the laminate 15 is not held on the support surface by the needles at this time, the laminate is being held against the suction port 3a by suction. As a result, the patterned sheets 15a do not become positionally displaced and the cutter of the cutting machine can be operated without being obstructed by the needles. Extracting the needles during this operation is unnecessary. Accordingly, cutting of the laminate can be performed accurately and with excellent operability.

Figure 6:
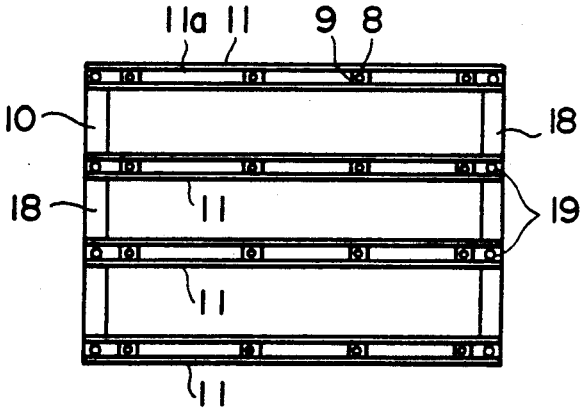
FIG. 6 is a plan view showing a modification of the base member.

FIG. 6 illustrates a modification of the base member 10. Here the base member 10 includes a plurality of connecting rods 18 perpendicularly crossing the plurality of holding rails 11. The rails 11 are fastened to the connecting rods 18 by assembly screws 19 and are thereby fixed in a frame-like configuration. The base member 10 shown in FIG. 6 can be used in the same manner as that shown in FIGS. 2, 4 and 5. Portions in FIG. 6 identical with those shown in FIGS. 2, 4 and 5 are designated by like reference characters.

Figure 7:
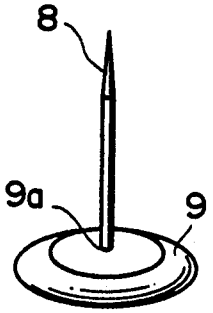
FIGS. 7 and 8 are an enlarged perspective view and a partial perspective view showing a needle holder and a base member, respectively, according to another embodiment of the present invention.
Figure 8:
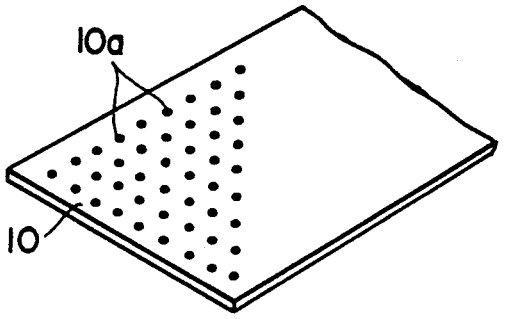

FIGS. 7 and 8 illustrate another embodiment of the needle holder 9 and base member 10. The needle holder 9 shown in FIG. 7 is formed in the shape of a substantially inverted saucer and has a centrally located hole 9a in which the base of the needle 8 is so retained that the needle can be attached and detached. The base member 10 shown in FIG. 8 comprises a planar rectangularly shaped sheet in which a multiplicity of needle retaining holes 10a are formed in rows and columns at a prescribed spacing.

In accordance with this embodiment, the first step of the cutting method includes inserting the bases of the needles 8 into desired ones of the needle retaining holes 10a of the base member 10 from above, and press-fitting the portions of the needles 8 that protrude from the lower surface of the base member 10 into the holes 9a of the holders 9. Under these conditions, the base member 10 is placed and supported on the support surface of the pedestal via the needle holders 9. The fifth step of the cutting method includes pulling the needles 8 upward to extract them from the base member 10 and needle holders 9 after the laminate has been attracted to the suction port by suction, and withdrawing the needle holders 9 and base member 10 from between the support surface and the lower air-impermeable sheet. Other structural components and cutting steps in this embodiment are similar to those of the embodiment illustrated in FIGS. 1 through 5.

In the present invention, the spacer of the foregoing embodiment interposed between the suction port and the laminate may be deleted and the laminate may be brought into direct contact with the suction port or situated in close proximity thereto. Though the embodiment described above is for a case where a manually guided cutter is used, the present invention is such that a laminate of patterned sheets can be cut using an automatic cutting machine. It is also possible to provide two suction pipes and arrange them so that their suction ports oppose both side edges of the laminate.

Thus, as described above, a method of cutting patterned sheets in accordance with the present invention is such that holders in which needles are capable of being inserted and withdrawn are held on a sheet-like or frame like base member, in which state the base member is supported on a support surface. As a result, the patterned sheets, such as patterned cloth, are accurately matched using the needles while the positions of the patterns on the sheets are verified, and the patterned sheets can be stacked on the support surface via the lower air-impermeable sheet and base member. In addition, the laminate of patterned sheets stacked with their patterns matched is surrounded by the upper and lower air-impermeable sheets, and one side face of the laminate is subjected to suction from a suction port to compress the laminate and cause it to be held by the suction port due to the suction applied. Under these conditions, the needles are extracted from the needle holders, and the needle holder and base member can be withdrawn from between the pedestal and the lower air-impermeable sheet. In this case, the upper and lower air-impermeable sheets and the laminate are being attracted to the suction port, so that the needles, the needle holders and the base member can be extracted with ease. Moreover, there is no shift in the positions of the patterns on the stacked patterned sheets. In other words, according to the cutting method of the present invention, the position of the laminate is retained by the needles until the laminate is subjected to suction. After suction is applied, the laminate is retained by the force of compression and cutting can be performed in a state in which all of the needles have been extracted. Accordingly, the laminate can be cut by a cutter operated under manual guidance or by the cutter of an automatic cutting machine having a suction device, without the needles impeding the cutting operation. Since an operation for pulling out the pins need not be inserted during the cutting operation, cutting can be performed efficiently and accurately without the patterns on the patterned sheets being shifted in position at cutting. Furthermore, the apparatus for cutting patterned sheets according to the invention is so adapted that the needles are extracted from both the needle holders and base member. Therefore, the needle holders and base member can readily be removed from above the support surface of the pedestal after the needles are extracted. Thus, the apparatus of the invention is ideal for practicing the cutting method described above.

As many apparently widely different embodiments of the present invention can be made without departing from the spirit and scope thereof, it is to be understood that the invention is not limited to the specific embodiments thereof except as defined in appended claims.

What is claimed is:

1. A method of cutting patterned sheets comprising the steps of:

positioning a plurality of needle holders having removable needles therein in a base member;

placing said base member on a support surface such that said needles are upwardly directed;

impaling a lower air-impermeable sheet which is larger than said patterned sheets on said needles, said lower air-impermeable sheet being supported by said base member and said support surface;

stacking said patterned sheets on said lower air-impermeable sheet to form a laminate, said stacking being done by impaling said patterned sheets on said needles to match said patterns on each sheet;

covering the upper and all side surfaces of the laminate of said patterned sheets except a side surface that opposes a suction port with an upper air-impermeable sheet that is larger than said patterned sheets, said upper air-impermeable sheet being impaled on said needles, said laminate being substantially enveloped in said upper and lower air-impermeable sheets;

applying suction via said suction port to said laminate and said air-impermeable sheet, said suction acting to compress and hold said laminate and said air-impermeable sheets against said support surface and said suction port;

extracting said needles from said needle holders, said laminate, and said upper and lower air-impermeable sheets while said suction is holding said laminate together;

removing said needle holders and said base member from between said support surface and said lower air-impermeable sheet; and cutting said laminate and said upper and lower air-impermeable sheets held on the suction port by suction, while continuing to apply said suction.

2. The method according to claim 1, wherein said lower air-impermeable sheet is impaled upon said needles and supported on said support surface via the base member after said base member is placed on said support surface and detachably secured thereto.

3. The method according to claim 2, wherein the entire outer surface of said laminate, with the exception of the side thereof opposing the suction port, is covered with the upper and lower air-impermeable sheets, outer edge portions of said upper and lower air-impermeable sheets, with the exception of edge portions on the side facing the suction port, are made to overlap each other, and the overlapped edge portions are sealed by adhesive tape, after which said laminate is compressed on said support surface and held on the suction port under suction by drawing in air from said suction port.

4. The method according to claim 1, wherein the entire outer surface of said laminate, with the exception of the side thereof opposing the suction port, is covered with the upper and lower air-impermeable sheets, the outer edge portions of said upper and lower air-impermeable sheets, with the exception of edge portions on the side facing the suction port, are made to overlap each other, and the overlapped edge portions are sealed by adhesive tape, after which said laminate is compressed on said support surface and held on the suction port under suction by drawing in air from said suction port.

5. An apparatus for cutting patterned sheets, comprising:

a support surface formed on an upper side of a pedestal;

needle holders having removable needles therein;

a base member detachably disposed on said support surface for releasably and adjustably holding said needle holders with said needles, said base member comprising a rectangular base sheet; a plurality of holding rails fixed in parallel with said base sheet and extending longitudinally thereon such that said rails are spaced along the width of said base sheet, each of said rails defining along its length in its uppermost surface opposite of said base sheet a groove for slidably holding said needle holders and needles, said groove having longitudinally extending upper surface projections to narrow its upper side, said needle holders being slidable in the lower side of said groove below said projections;

set screw means to set said needle holders within said grooves to prevent said needle holders from sliding therein; and a suction pipe disposed on one side edge of said support surface and defining a suction port longitudinally therein, said suction port opening on a central side of said support surface.

6. The apparatus according to claim 5, wherein said rectangularly shaped sheet is planar and said needles are held in rows and columns, portions of said needles protruding from below said rectangularly shaped sheet and press-fit into said needle holders, said sheet having been placed upon the support surface of said pedestal via said needle holders.

7. An apparatus for cutting patterned sheets, comprising:

a support surface formed on an upper side of a pedestal;

needle holders having removable needles therein;

a base member detachably disposed on said support surface for removably and adjustably holding said needle holders with said needles, said base member comprising a rectangular sheet, and a plurality of holding rails fixed in parallel with said sheet and spaced along the width thereof, each of said rails forming along the length of its upper surface opposite said base a groove, said groove having longitudinally extending projections in its upper surface to narrow the width thereof in said upper surface, said needle holders being slidably received under said longitudinally extending projections and within said groove;

set screws for fixedly locating said needle holders within said grooves; and a suction pipe disposed on one side edge of said support surface and defining a suction port formed longitudinally along said suction pipe, said suction port opening on a central side of said support surface.

* * * * *